US008123462B2

(12) United States Patent
Hofer

(10) Patent No.: US 8,123,462 B2
(45) Date of Patent: Feb. 28, 2012

(54) PRESSURIZED SEALED CHAMBER BETWEEN MULTIPLE PRESSURIZED CASINGS OF MACHINE AND RELATED METHOD

(75) Inventor: Douglas Carl Hofer, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 795 days.

(21) Appl. No.: 12/251,725

(22) Filed: Oct. 15, 2008

(65) Prior Publication Data

US 2010/0092287 A1 Apr. 15, 2010

(51) Int. Cl.
*F04D 29/10* (2006.01)
*B21K 25/00* (2006.01)

(52) U.S. Cl. ..... 415/109; 415/111; 415/229; 415/230; 29/888.3

(58) Field of Classification Search ..... 415/109, 415/111, 168.2, 226, 229; 29/888.3
See application file for complete search history.

(56) References Cited

U.S. PATENT DOCUMENTS 5,632,492 A * 5/1997 Lehmann et al. ..... 277/409
2004/0175262 A1* 9/2004 Burdgick ..... 415/111

FOREIGN PATENT DOCUMENTS

EP 407132 A1 * 1/1991

* cited by examiner

*Primary Examiner* — Stephen W Smoot
(74) *Attorney, Agent, or Firm* — Hoffman Warnick LLC; Ernest G. Cusick

(57) ABSTRACT

A standard for supporting a bearing for a rotating shaft of a machine including a plurality of casings having different gas pressures greater than atmospheric pressure includes a sealed chamber for fluidly coupling to an end packing of a first casing and a second casing of the machine, the sealed chamber having a pressure greater than atmospheric pressure. The pressure in the sealed chamber reduces the leakage from the casing making more pressurized gas available for producing work in the machine.

16 Claims, 1 Drawing Sheet

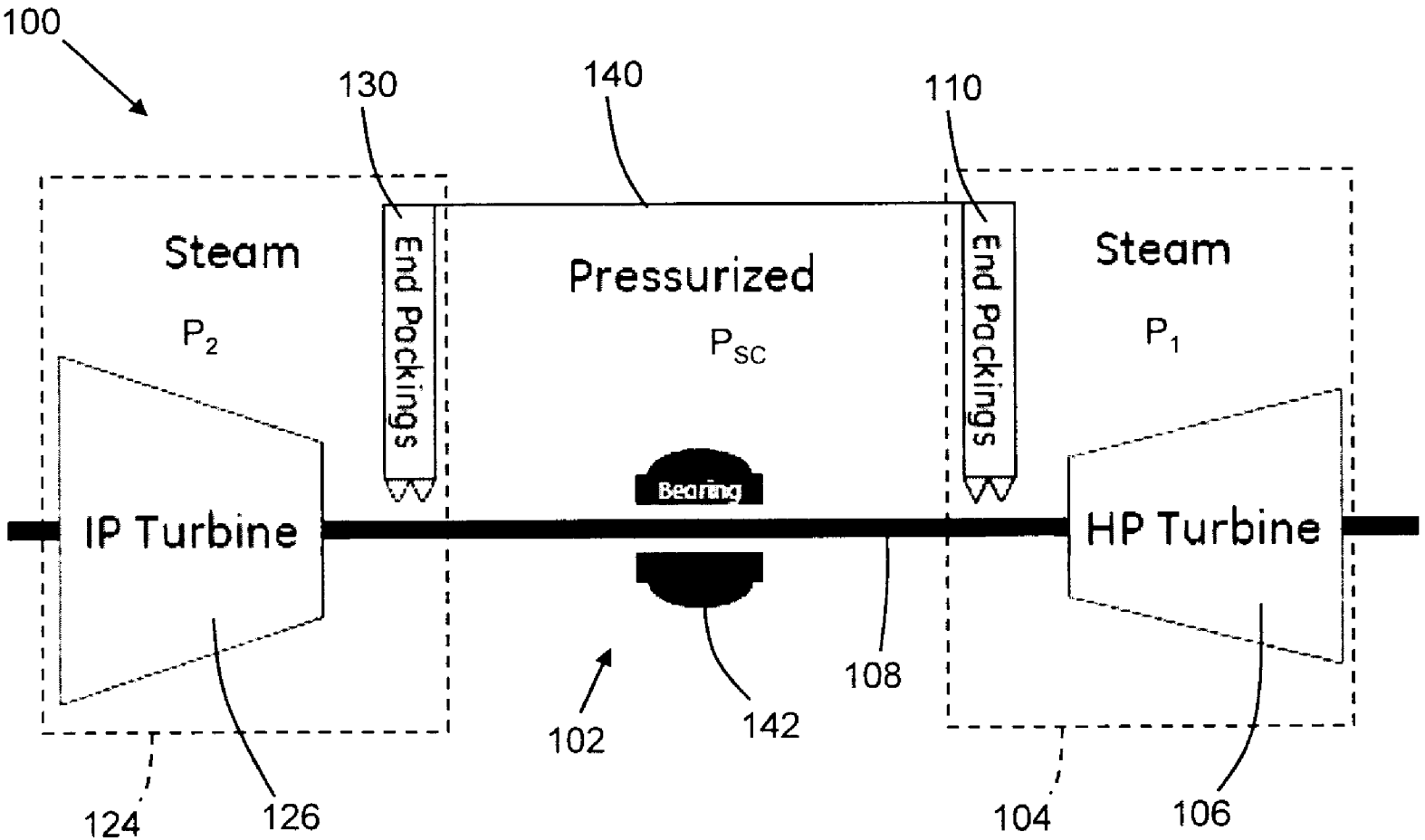
Steam
$P_1$
HP Turbine
106
104
110
End Packings
108
Pressurized
$P_{SC}$
Bearing
142
140
102
130
End Packings
Steam
$P_2$
IP Turbine
126
124
100

PRESSURIZED SEALED CHAMBER BETWEEN MULTIPLE PRESSURIZED CASINGS OF MACHINE AND RELATED METHOD

BACKGROUND OF THE INVENTION

The invention relates generally to steam turbines, gas compressors, or any device with a rotating shaft that penetrates multiple pressurized casings and has a bearing between those casings. More particularly, the invention relates to increasing the pressure in the vicinity of the bearing between multiple casings to reduce the leakage from the casings around the shaft.

Current turbo-machines such as steam turbines often employ multiple casings with bearings residing in stationary standards between the casings. In current practice, the bearings operate in an environment of atmospheric air. Operating the bearing at atmospheric pressure requires the higher pressure gas or steam within the casing to be sealed against a pressure difference equal to the gauge pressure present at the end of the casing. To contain the gas or steam within the casing, each casing includes a series of non-contacting gland seals, referred to as an end packing. Each end packing includes a number of non-contacting seals such as leaf seals, brush seals, labyrinth seals, etc., that partially seal against the rotating shaft of the steam turbine. Due to the finite clearance in these seals there is an inevitable leakage of gas or steam that results in lost potential to produce rotating shaft work in a turbine or increased shaft work required in a compressor. The rate of leakage is dependent upon the seal geometry, clearance, and pressure difference between the gas or steam inside the casing and the air outside the casing.

BRIEF DESCRIPTION OF THE INVENTION

A first aspect of the disclosure provides a machine comprising: a rotating shaft; a plurality of casings, each casing including: a part operably coupled to the rotating shaft and operable at a pressure greater than atmospheric pressure, and an end packing for partially sealing the respective casing to the rotating shaft; a sealed chamber fluidly coupling the first end packing and the second end packing, the sealed chamber having a third pressure greater than atmospheric pressure; and a bearing positioned within the sealed chamber between the first casing and the second casing for supporting the rotating shaft.

A second aspect of the disclosure provides a method comprising: providing a machine including a rotating shaft and a plurality of casings, each casing including: a part operably coupled to the rotating shaft and operable at a pressure greater than atmospheric pressure, and an end packing for partially sealing the respective casing with the rotating shaft; providing a standard positioned between two casings, the standard supporting a bearing for the rotating shaft; and sealing the standard in a sealed chamber fluidly coupling the two casings, the sealed chamber having a pressure greater than atmospheric pressure.

A third aspect of the disclosure provides a standard for supporting a bearing for a rotating shaft extending between a plurality of casings, each casing having a different pressure greater than atmospheric pressure, the standard comprising: a sealed chamber for fluidly coupling to an end packing of a first casing and a second casing, the sealed chamber having a pressure greater than atmospheric pressure.

BRIEF DESCRIPTION OF THE DRAWINGS

FIG. 1 shows a schematic diagram of a multiple casing steam turbine including a standard according to the disclosure.

DETAILED DESCRIPTION OF THE INVENTION

FIG. 1 shows a machine 100 including a standard 102 according to embodiments of the disclosure. Machine 100 includes a plurality of casings 104, 124, each casing including a part 124, 126 operably coupled to a rotating shaft 108 and operable at a pressure greater than atmospheric pressure. In one embodiment, machine 100 takes the form of a steam turbine including a first casing 104 including a first turbine 106 operably coupled to a rotating shaft 108 and operable at a pressure greater than atmospheric pressure, i.e., about 14.7 pounds per square inch absolute (psia). In one example, first turbine 106 is a high pressure (HP) turbine that may operate, for example, at a first pressure $P_1$ ranging from about 1000 psia and about 3500 psia. First casing 104 also includes an end packing 110 for partially sealing the casing with rotating shaft 108. Machine 100 may also include a second casing 124 including a second turbine 126 operably coupled to rotating shaft 108. Second turbine 126 is operable at a second pressure greater than atmospheric pressure. In one example, second turbine 126 is an intermediate pressure (IP) turbine that may operate, for example, at a second pressure $P_2$ ranging from about 200 psia to about 600 psia. Consequently, the first pressure $P_1$ in first casing 104 is greater than the second pressure $P_2$ in second casing 124. Second casing 124 also includes an end packing 130 for partially sealing the casing with rotating shaft 108. As understood, other turbine(s) in more casings such as a low pressure (LP) turbine, not shown, may also be provided.

Each end packing 110, 130 includes a number of non-contacting seals such as leaf seals, brush seals, labyrinth seals, etc., that partially seal against rotating shaft 108 of steam turbine 100. As understood, second end packings 110, 130, however, do not completely seal casings 104, 124 with rotating shaft 108. Conventionally, an area between end packings of a multiple casing steam turbine and the structure therein such as a standard for a bearing for supporting the rotating shaft are provided at atmospheric pressure.

In order to reduce leakage from casings 104, 124, embodiments of the disclosure provide a sealed chamber 140 fluidly coupling first end packing 110 and second end packing 130. Sealed chamber 140 may be provided in a number of ways such as a cover sealingly coupled to each end packing 110, 130 as part of standard 102. Sealed chamber 140 is pressurized to a third pressure $P_{SC}$ greater than atmospheric pressure. In one embodiment, the pressure within sealed chamber 140 ranges from about 300 psia to about 350 psia, e.g., 325 psia. Pressure within sealed chamber 140 may be slightly higher than that of second, lower pressure casing 124, e.g., 20-100 psia greater. However, this is not necessary as the first and second pressures $P_1$ and $P_2$ may both be greater than the third pressure $P_{SC}$. Standard 102 supports a bearing 142 for rotating shaft 108. The gas within sealed chamber 140 may be different than that in casings 104, 124 (or the surrounding atmosphere) and may include, for example, air, an inert gas or a combination thereof.

Although particular pressures have been disclosed relative to casings 104, 124 and sealed chamber 140, it is understood that the teachings of the disclosure are not to be limited to those particular pressures. The teachings of the disclosure can be applied to any steam turbine, compressor or other device having multiple casings penetrated by a rotating shaft having differences in pressure between casings. As understood, the structure of a compressor is very similar to that of a steam turbine as described herein. In the case of a compressor, a first compressor 106 (formerly first turbine) may operate at a first pressure $P_1$, and a second compressor 126 (formerly second turbine) may operate at a second pressure $P_2$ greater than atmospheric pressure. In any event, the first pressure $P_1$ in first casing 104 is greater than the second pressure $P_2$ in second casing 124.

Embodiments of the disclosure also provide a method including providing a machine 100 and a standard 102 and sealing the standard in sealed chamber 140 fluidly coupling the two casings, the sealed chamber having a pressure greater than atmospheric pressure. Embodiments of the disclosure also include standard 102 for supporting bearing 142 for rotating shaft 108 of machine 100. In this case, standard 102 includes sealed chamber 140 for fluidly coupling to an end packing 110, 130 of first casing 104 and second casing 124 of the machine. Again, sealed chamber 140 has a pressure $P_{SC}$ greater than atmospheric pressure.

The above described embodiments of the present disclosure increase the power output and efficiency of a machine such as steam turbine or gas compressor with split casings (e.g., high pressure and intermediate pressure). Increased output and efficiency results in greater performance of machine 100.

It is emphasized that while the disclosure has been described relative to a steam turbine, that the teachings of the disclosure are applicable to any device with a rotating shaft that penetrates multiple pressurized casings and has a bearing between those casings, e.g., a gas compressor.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 wt %, or, more specifically, about 5 wt % to about 20 wt %", is inclusive of the endpoints and all intermediate values of the ranges of "about 5 wt % to about 25 wt %," etc).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A machine comprising:

a rotating shaft;

a plurality of casings, each casing including: a part operably coupled to the rotating shaft and operable at a pressure greater than atmospheric pressure, and an end packing for partially sealing the respective casing to the rotating shaft;

a scaled chamber fluidly coupling a first end packing in the plurality of casings and a second end packing in the plurality of casings, the sealed chamber having a third pressure greater than atmospheric pressure; and a bearing positioned within the sealed chamber between two casings in the plurality of casings, the bearing for supporting the rotating shaft.

2. The machine of claim 1, wherein the plurality of casings include:

a first casing including a first turbine or compressor operably coupled to the rotating shaft and operable at a first pressure greater than atmospheric pressure and a first end packing for partially sealing the first casing with the rotating shaft; and a second casing including a second turbine or compressor operably coupled to the rotating shaft and operable at a second pressure greater than atmospheric pressure and a second end packing for partially sealing the second casing with the rotating shaft.

3. The machine of claim 2, wherein the first pressure is greater than the second pressure and the first and second pressure are greater than the third pressure.

4. The machine of claim 2, wherein the machine includes a steam turbine and the first pressure ranges from about 1000 pounds per square inch absolute (psia) and about 3500 psia, the second pressure ranges from about 200 psia to about 600 psia, and the third pressure ranges from about 300 psia to about 350 psia.

5. The machine of claim 1, wherein the sealed chamber and the bearing are contained within a standard.

6. The machine of claim 1, wherein the scaled chamber includes a gas that is different than that in each casing.

7. A method comprising:

providing a machine including a rotating shaft and a plurality of casings, each casing including: a part operably coupled to the rotating shaft and operable at a pressure greater than atmospheric pressure, and an end packing for partially sealing the respective casing with the rotating shaft;

providing a standard positioned between two casings, the standard supporting a bearing for the rotating shaft; and sealing the standard in a sealed chamber fluidly coupling the two casings, the sealed chamber having a third pressure greater than atmospheric pressure.

8. The method of claim 7, wherein the plurality of casings include:

a first casing including a first turbine or compressor operably coupled to the rotating shaft and operable at a first pressure greater than atmospheric pressure and a first end packing for partially sealing the first casing with the rotating shaft; and a second casing including a second turbine or compressor operably coupled to the rotating shaft and operable at a second pressure greater than atmospheric pressure and a second end packing for partially sealing the second casing with the rotating shaft.

9. The method of claim 8, wherein the first pressure is greater than the second pressure and the first and second pressure are greater than the third pressure.

10. The method of claim 8, wherein the machine includes a steam turbine and the first pressure ranges from about 1000 pounds per square inch absolute (psia) and about 3500 psia, the second pressure ranges from about 200 psia to about 600 psia, and the third pressure ranges from about 300 psia to about 350 psia.

11. The method of claim 7, wherein the sealed chamber includes a gas that is different than that in each casing.

12. A standard for supporting a bearing for a rotating shaft extending between a plurality of casings, each casing having a different pressure greater than atmospheric pressure, the standard comprising:

a sealed chamber for fluidly coupling to an end packing of a first casing and a second casing, the sealed chamber having a third pressure greater than atmospheric pressure.

13. The standard of claim 12, wherein the plurality of casings include:

a first casing including a first turbine operably coupled to the rotating shaft and operable at a first pressure greater than atmospheric pressure and a first end packing for partially scaling the first casing; and a second casing including a second turbine operably coupled to the rotating shaft and operable at a second pressure greater than atmospheric pressure and a second end packing for partially sealing the second casing.

14. The standard of claim 13, wherein the first pressure is greater than the second pressure and the first and second pressure are greater than the third pressure.

15. The standard of claim 13, wherein the first pressure ranges from about 1000 pounds per square inch absolute (psia) and about 3500 psia, the second pressure ranges from about 200 psia to about 600 psia, and the third pressure ranges from about 300 psia to about 350 psia.

16. The standard of claim 12, wherein the sealed chamber includes a gas that is different than that in each casing.

* * * * *

UNITED STATES PATENT AND TRADEMARK OFFICE

CERTIFICATE OF CORRECTION

PATENT NO. : 8,123,462 B2
APPLICATION NO. : 12/251725
DATED : February 28, 2012
INVENTOR(S) : Douglas Carl Hofer It is certified that error appears in the above-identified patent and that said Letters Patent is hereby corrected as shown below:

In Column 4, line 4, delete:

"a scaled chamber"

Insert:

-- a sealed chamber --

In Column 4, line 36, delete:

"the scaled chamber"

Insert:

-- the sealed chamber --

In Colum 6, line 2, delete:

"partially scaling"

Insert:

-- partially sealing --

Signed and Sealed this
Twenty-eighth Day of August, 2012

David J. Kappos

David J. Kappos
*Director of the United States Patent and Trademark Office*